252-104 AU 165 EX
3/22/77 OR 4,013,575

United States Patent [19]
Castrantas et al.
[11] 4,013,575
[45] Mar. 22, 1977

[54] DRY CLEANING WITH PERACIDS

[75] Inventors: Harry Marcus Castrantas, Newtown, Pa.; John T. Gresham, Skillman, N.J.

[73] Assignee: FMC Corporation, Philadelphia, Pa.

[22] Filed: Nov. 28, 1975

[21] Appl. No.: 636,078

[52] U.S. Cl. ..... 252/104; 8/111; 8/142; 252/103
[51] Int. Cl.² ..... C11D 7/54
[58] Field of Search ..... 252/104, 103; 8/111, 8/111.5, 142

[56] References Cited

UNITED STATES PATENTS

| | | | |
|---|---|---|---|
| 3,634,020 | 1/1972 | Hemlick | 8/142 |
| 3,838,967 | 10/1974 | Shepley | 8/111 |
| 3,925,008 | 12/1975 | Makino et al. | 8/111 |

*Primary Examiner*—Mayer Weinblatt
*Attorney, Agent, or Firm*—Gary M. Nath; Frank Ianno; Pauline Newman

[57] ABSTRACT

Textile fabric stain removal is significantly improved by including in conventional dry cleaning solvent baths, a preformed or in situ generated peracid.

19 Claims, No Drawings

DRY CLEANING WITH PERACIDS

This invention relates to dry cleaning formulations containing a peracid as an essential component.

The general technique for dry cleaning garments and other articles made of textile fibers, which are not resistant to ordinary washing with aqueous detergents, involves treating the textiles with a bath consisting of about 0.1 to 5% of a suitable detergent and a small amount of water, usually about 0.02 to 2.0%, both dispersed in a solvent such as a petroleum distillate, a chlorinated solvent such as trichloroethylene, perchloroethylene, trifluorodichlorethane or other highly halogenated solvent. About 5 to 20 times as much solvent bath is used per weight of fabric to insure proper cleaning which is generally carried out at room temperature for about 5 to about 20 minutes.

A major difficulty with conventional dry cleaning processes have been their inability to effectively remove stains while maintaining garment whiteness and/or colored fabric brightness, particularly in polyester/cotton blended textile fabric. The prior art has attempted to overcome this difficulty by introducing various bleaching agents, such as hydrogen peroxide, into dry cleaning processes. While the stain removal problem has been partially overcome with particular stains by employing hydrogen peroxide, some fabric treated with hydrogen peroxide has exhibited loss of strength upon repeated cleaning, apparently due to cellulose degradation.

U.S. Pat. No. 3,635,667 discloses a process for obtaining acceptable fabric whitening without decreasing fabric strength by employing a dry cleaning solvent having a pH value of at least 7.0 which contains in controlled proportions hydrogen peroxide, water, and a volatile alkali. Ammonium hydroxide is disclosed as the preferred volatile alkali because of its availability. This alkali, however, is disadvantageous because of its detectable odor and because it is not removed during the solvent distillation operation used to purify the solvent. Another process suggests employing hydrogen peroxide with different alkaline bases, such as sodium hydroxide, sodium silicate, and sodium carbonate, which bases are used to maintain the pH value of the bath around 10.8. Use of a highly alkaline bath, however, is not desirable since it may cause skin irritation arising from residual base remaining on the cleaned fabric, and because it may cause odor problems which occur at pH values above 9 when amine type containing detergents are employed, such as the isopropylamine salt of an alkylbenzenesulfonate.

In view of these prior art developments, a need exists for a dry cleaning formulation which has an improved stain removal capability over hydrogen peroxide containing systems and which will maintain fabric strength, garment whiteness, and colored fabric brightness.

An improved dry cleaning emulsion formulation which achieves all of these long felt needs has been unexpectedly discovered which consists essentially of:

a. about 0.1 to 30% by weight water;
b. about 0.1 to about 5.0% by weight surfactant;
c. a sufficient amount of an emulsion soluble peracid to provide about 0.001 to 0.15% by weight A.O.;
d. a sufficient amount of alkali to maintain the pH value of the emulsion between 2.0 and 9.0; and
e. the remainder being at least 69% by weight of a dry cleaning solvent.

The novel dry cleaning formulations of this invention contain a non-aqueous liquid dry cleaning solvent in amounts of at least 69%, and preferably from 96.0% to 98.7% by weight based on the weight of the dry cleaning formulation. Conventional solvents, such as petroleum distillates, Stoddard type solvents, and halogenated dry cleaning solvents have been found useful. Preferred dry cleaning solvents are selected from the group consisting of perchloroethylene, trichloroethylene, 1,1,1-trichloro-2,2,2-trifluoroethane, methylchloroform, 1,1,2,2-tetrachloro-1,2-difluoroethane, trichlorofluoromethane, 1,1,2-trichloro-1,2,2-trifluoroethane, 1,1,1,2-tetrachloro-1,2-difluoroethane, 2,2,3-trichloro-1,1,1,3,3-pentafluoropropane, 1,2,2,3,3-pentachloro-1,1,3-trifluoropropane, and hexafluorodichlorobutene.

The water concentration of the dry cleaning formulation ranges from about 0.1 to about 30% by weight of the total formulation with amounts from 1 to 3% by weight being preferred. Water concentrations between 3 and 30% while usable are not preferred since they place a heavy energy demand upon the solvent distillation system used to reclaim contaminated dry cleaning solvent.

Any surfactant which is capable of emulsifying water in the solvent or visa versa and which does not react with the peracid can be used. The surfactant is preferably employed in amounts between about 0.1 and about 5% by weight. The dry cleaning surfactants are usually proprietary compositions of anionic, cationic, and/or nonionic surfactants. Exemplary surfactants are described in U.S. Pat. No. 3,635,67.

The pH value of the formulation must be from 2.0 to 9.0, and preferably between 5.0 and 7.0. The pH value of the bath is adjusted by the addition of minor amounts of alkali, such as sodium hydroxide, sodium bicarbonate, sodium carbonate and/or an inorganic polyphosphate salt, preferably as an aqueous alkaline solution. It is preferable to keep the pH value of the bath at or above 5.0 to avoid equipment corrosion even through bleaching effectiveness is increased at pH values between 2.0 and 5.0. The pH value of the bath must be kept below 9.0 to prevent the formation of odors resulting from the reaction of the alkali with amine based surfactants, such as the isopropylamine salt of an alkylbenzenesulfonate, as well as to avoid excessive peracid decomposition which progressively increases at pH values above 7.0.

By employing small amounts of a water-soluble inorganic polyphosphate salt in the dry cleaning formulation, which may be accompanied by the addition of other alkali if necessary to adjust the pH value of the bath to the desired level, stain removal is significantly improved, less fabric degradation is noted, and a lower rate of equipment corrosion relative to which is normally found with hydrogen peroxide systems is achieved. These improvements are noted when the water-soluble inorganic polyphosphate salt is employed in amounts from about 0.08 to about 12% by weight and most preferably 0.4% to 1.6% by weight based on the weight of the water present. The amounts are based upon the water present in the formulation in view of the different inorganic polyphosphate salt water-solubilities in order to eliminate wasteful salt precipitation in the bath. For example, sodium tripolyphosphate is soluble in water at 25° C to about 50° C to the extent of about 15%, whereas tetrasodium pyrophosphate is 6% soluble in water at 25° C but 13% soluble at 50° C.

The preferred water-soluble inorganic polyphosphate salts are nonvolatile compounds that are easily removed from the dry cleaning solvent during the distillation operation conventionally used to reclaim the dirty solvent, and include sodium tripolyphosphate, tetrasodium pyrophosphate, potassium tripolyphosphate, tetrapotassium pyrophosphate, sodium acid pyrophosphate, and glassy phosphates such as Hexaphos, Sodaphos and Glass-H, with sodium tripolyphosphate being preferred.

The formulations of this invention contain as an essential component a peracid which is added as a preformed peracid or prepared in situ by the reaction of a peroxygen compound with a peroxygen activator. The use of a peracid in a dry cleaning formulation unexpectedly results in up to 40% better fabric stain removal and better fabric strength retention over that obtained by conventional hydrogen peroxide dry cleaning formulations.

The peracid must be present in the formulation in sufficient amounts to provide about 0.001 to 0.15% by weight A.O. (Active Oxygen) based upon the weight of the bath, and preferably about 0.002 to 0.004% A.O., whether the peracid is added as such or prepared in situ. Amounts of peracid which provide above 0.15% by weight A.O. do not significantly improve bleaching performance and are accordingly not economical.

The peracids employed according to the process of the invention must be a more powerful bleaching agent than hydrogen peroxide and must be soluble in a water-solvent emulsion. Preferred preformed peracids include perbenzoic acid, monoperphthalic acid, permaleic acid, peracetic acid, performic acid, perpropionic acid, p-nitroperbenzoic acid, perazelaic acid, and m-chloroperbenzoic acid.

Any in situ prepared peracid which is a more powerful bleaching agent than hydrogen peroxide which is formed reasonably fast by the reaction of the peroxygen compound and the activator at dry cleaning temperatures (20° to 55° C) and which is soluble in the water-solvent dry cleaning emulsion formulation will perform adequately. The preferred procedure for preparing the peracid in situ is to admix in a previously emulsified dry cleaning solvent bath the peroxide compound and the activator in a molar ratio of 1:0.5 to 2.0, and preferably 1:1 respectively. Most preferably, admixing is performed after the pH value of the bath is adjusted from 2.0 to 9.0 with a sufficient amount of an aqueous alkaline solution. Other well known procedures for preparing peracids in solution may also be employed.

The peroxygen compound must be soluble in the aqueous phase of the bath in order to rapidly form the peracid in sufficient amounts to effectively remove textile stains. Suitable water-soluble peroxygen compounds include hydrogen peroxide, sodium perborate, sodium carbonate peroxide, sodium pyrophosphate perhydrate, zinc peroxide, magnesium peroxide, calcium peroxide, urea peroxide, and potassium caroate, with hyrogen peroxide preferred.

Suitable activators may be selected from a wide range of compounds which react with peroxygen compounds to form the corresponding peracid in the aqueous phase of the bath. The activator must be soluble in the solvent phase of the bath even though the activator may have an affinity for water. It is believed that the solvent acts as an activator reservoir which continuously supplies activator through the water-solvent interface where the activator is rapidly reacted with the peroxygen compound to form the corresponding emulsion soluble peracid. By employing a solvent-soluble activator and a water-soluble peroxygen, sufficient and controlled amounts of peracid are generated to clean the soiled textile fabric while avoiding the possibility of forming excessive amounts of localized peracid which might cause over bleaching, fabric degradation and loss of fabric tensile strength.

The activator may be a material selected from the group consisting of aliphatic acids, carboxylic acid anhydrides and mixed anhydrides, amide derivatives, reactive esters, aryl sulfonyl chlorides, diacyl peroxides and miscellaneous activators.

Suitable aliphatic acids include formic acid, acetic acid, and propionic acid, with formic acid preferred because it forms a peracid rapidly and directly without a separate acid catalyst being needed.

Suitable carboxylic acid anhydrides and mixed anhydrides include phthalic anhydride, 4-chlorophthalic anhydride, nonenylsuccinic anhydride, acetic anhydride, phthalic/benzoic anhydride, succinic/benzoic anhydride, succinic/phthalic anhydride, maleic/benzoic anhydride, tetrahydrophthalic anhydride, trimellitic anhydride, maleic anhydride, glutaric anhydride, acetic/propionic anhydride, 1,2,4,5-benzenetetracarboxylic anhydride, O-sulfobenzoic anhydride, azelaic anhydride, and 3,3',4,4'-benzophenonetetracarboxylic dianhydride and polyazelaic polyanhydride; with the first five anhydrides being preferred. While acetic anhydride is suitable, it is not recommended in view of the possible formation of explosive diacetyl peroxide which may accompany the reaction between acetic anhydride and hydrogen peroxide.

Suitable amide derivatives include N-benzoylsuccinimide, N-benzoylcaprolactam, N-benzoyldimethylhydantoin, benzoyliminodiacetonitrile, N,N-dicyanomethylpropionamide, tetraacetylethylenediamine, tetraacetylglycoluril, N-acetylsuccinimide and N-methyldiacetamide.

Suitable reactive esters include the esters of phenols: phenyl benzoate, o-carboxyphenyl benzoate, chlorophenyl benzoate, phenyl acetate, p-cresyl acetate, and p-bromophenyl benzoate; the esters of polyhydric alcohols containing several ester groups situated on adjacent carbon atoms: mannitol hexaacetate, sorbitol hexaacetate, and triacetin; the esters of mono- and disaccarides containing 3 or more ester groups on adjacent carbon atoms: glucose pentaacetate, sucrose octaacetate, fructose pentaacetate, and glucose tetraacetate; the esters having two ester groups attached to the same carbon atoms: methylene dibenzoate, trichloroethylene dibenzoate, chloral diacetate, furfural diacetate and benzaldehyde diacetate; the esters of enolic forms of ketones: cyclohexenyl acetate, and isopropenyl acetate; the esters of N-substituted hydroxylamines: such as acetylacetohydroxamic acid; the esters of alcohols containing electron-attracting substituents: such as trichloroethyl acetate; the phenyl carbonate esters: such as p-sulfophenyl ethyl carbonate; and the esters of cyanuric acid: such as trisacetyl cyanurate, diacetyl cyanurate, sodium diacetyl cyanurate.

Suitable aryl sulfonyl chlorides include 4-chlorobenzenesulfonyl chloride, benzenesulfonyl chloride, 2,5-dichlorobenzene sulfonyl chloride, 3,4-dichlorobenzenesulfonyl chloride and p-toluenesulfonyl chloride. The diacyl peroxide such as glutaryl-benzoyl peroxide, benzoyl peroxide and lauroyl peroxide; as well as miscellaneous activators, such as N-benzoylimidazole, N-benzoylazalines, N-benzoylazole, isophoroneoximino acetate and chloroformates.

One method for preparing the dry cleaning formulations of this invention comprises emulsifying the dry cleaning solvent and water with a surfactant capable of emulsifying the water in the solvent. The resulting emulsion may be stored or prepared for immediate use by admixing the emulsion with a sufficient amount of an aqueous alkaline solution to adjust the pH value of the emulsion from 2.0 to 9.0. Alternatively, a water-soluble inorganic polyphosphate salt is admixed in the emulsion, and if necessary, additional alkali values are added. A sufficient amount of a peracid or a peroxygen compound and an activator for said peroxygen compound is then admixed in the emulsion to provide the necessary amount of active oxygen. The entire preparatory process is preferably performed at temperatures from 20° C to 55° C and most preferably at temperatures from 25° C to 40° C, which are the same temperatures normally used in dry cleaning. Once formulated, the dry cleaning formulation is either employed immediately or held in storage when the peracid is prepared in situ until at least 25% the peroxygen compound has been converted to the corresponding peracid, whereupon garment dry cleaning is commenced.

Textile fabric is cleaned by contacting the textile with a sufficient amount of the dry cleaning formulation to provide from 0.05 to 2.5% WOF (weight of fabric) peracid and preferably between 0.07 and 0.12% WOF peracid for a sufficient time and temperature to complete the desired bleaching reaction. Following the bleaching reaction, the textile fabric is removed from the bath, rinsed, and dried and optionally steam treated. The minimum time needed for maximum stain removal when using the formulations of this invention will vary with the specific peracid and reaction temperature employed. Typically, 5 to 120 minutes and preferably 5 to 20 minutes at temperatures from 20° to 55° C, and preferably from 25° C to 40° C are sufficient to achieve maximum stain removal while maintaining fabric strength, garment whiteness and colored fabric brightness.

The invention will be better understood from a consideration of the following examples. All percentages are based upon weight unless otherwise indicated.

EXAMPLE 1

Inventive Runs 1 to 10,
Comparative Runs A, B, and C

This Example demonstrates the effectiveness of removing various stains from textile fabric with various dry cleaning formulations.

Fabric staining was carried out on 65/35 polyester/cotton white shirting fabric with durable press finish.

A. Coffee, and Motor Oil Staining Procedure: Fabric pieces measuring 15.2 × 15.2 cm were stained with coffee or motor oil according to the procedure set forth in AATCC Method 130-1969.

B. Blood Staining Procedure: 5 drops of whole human blood were dropped onto the center of a 15.2 × 15.2 cm piece of fabric. A piece of glassine paper, followed by a 5 pound weight were placed on the stain for 1 minute to remove excess fluid. The stained pieces were dried for 12 hours at 21° C at 65% relative humidity.

C. Blueberry, Catsup, and Mustard Staining Procedure: Ground blueberries, and commercially prepared mustard were applied to separate fabric pieces measuring 15.2 × 15.2 cm with a spatula, estimating a 5 drop quantity instead of an eyedropper as called for in AATCC 130 - 1969.

D. Lipstick Staining Procedure: Lipstick was applied to separate fabric pieces measuring 15.2 × 15.2 cm by rubbing a small quantity on the swatch.

E. Ballpoint Ink Staining Procedure: Ballpoint pen ink was applied to separate fabric pieces measuring 15.2 × 15.2 cm by making 15 strokes each, at right angles to one another, within a 2.5 cm diameter circle.

After staining, the fabric pieces were aged for about 7 days before dry cleaning. The fabric pieces to be dry cleaned were dipped in clear perchloroethylene for about 15 seconds prior to cleaning to prevent rapid absorption of water and peracid. The web fabric pieces were then transferred to a Launder-o-meter jar (13.5 × 7.0 cm) containing the formulated solutions set forth in Table 1 having a solvent to fabric parts ratio of 15:1. The hydrogen peroxide values are based on the weight % of 11.8% hydrogen peroxide. The formulations contained between 97.4 and 98.2% perchloroethylene as solvent, 0.5% isopropylamine salt of dodecylbenzenesulfonate (Atlas G-711) as surfactant, and between 1.2 and 1.9% water. The jar was rotated at 42 RPM for 15 or 30 minutes at 35° C. The fabric pieces were then removed, and excess liquid shaken off. The pieces were then dried in a forced air oven for 20 minutes at 82° C, followed by steaming at 100° C for 1 minute.

An Elrepho reflectometer was used to read reflectance values of the stained fabrics. The total percent of stain removal was determined using the formula:

$$\text{Total \% Stain removal} = \frac{\text{Reflectance after bleaching} - \text{Reflectance (stained) before bleaching}}{\text{Reflectance unstained} - \text{Reflectance (stained) before bleaching}} \times 100$$

Results are set forth in Table 1. Table 1 shows that substantial improvement in stain removal is obtained with the formulations of this invention over water and hydrogen peroxide systems over a wide pH range. The improvement is also evident at short as well as long dry cleaning cycles. It should be noted that stain removal differences of two points or more based on an average of different stains is considered significant. A negative % stain removal represents a darkening of the stain.

The abbreviations used in the Table mean the following:

STPP - sodium tripolyphosphate
SA/BA - succinic anhydride/benzoic anhydride in a 2:1 mole ratio
BA - benzoic anhydride
SA - succinic anhydride
PA - phthalic anhydride
SA/PA - succinic anhydride/phthalic anhydride in a 1:2 mole ratio
TACA - trisacetyl cyanurate
IPA - isopropenyl acetate
TAED - tetraacetylethylenediamine
HCOOH - formic acid

EXAMPLE 2

Inventive Runs 11 to 16

This Example compares fabric stain removal with formulations containing different bases.

The procedure of Example 1 was repeated with the formulations of Example 1 containing the bases and peroxygen source set forth in Table II. The fabric pieces were cleaned in one cycle for 15 minutes. Results are set forth in Table II.

EXAMPLE 3

Inventive Runs 17, 18, 19
Comparative Runs D, E, F

This Example compares fabric tensile strength retention with various fabric pieces dry cleaned with various formulations.

The procedure of Example 1 was repeated with three different types of fabric that were dry cleaned 25 times at 35° C for 15 minutes per cycle. Tensile strengths were determined using the ASTM-D-1682-69 one inch cut strip test. The formulations contained 97.6 or 97.5% perchloroethylene, 0.49% isopropylamine salt of dodecylbenzenesulfonate (Atlas G-711) and 1.8 or 1.9% water. Results are set forth in Table III.

EXAMPLE 4

Inventive Run 20
Comparative Run G

This Example compares the effect of color fading from repeated dry cleaning cycles.

The procedure of Example 3 was repeated with 50/50 PE/C durable press fabric pieces. A Hunter D-25 reflectometer was used to determine color differences.

The results are set forth in Table IV. The results show that fabric colorfastness was excellent when treated with the inventive formulation.

EXAMPLE 5

Inventive Run 21

The procedure of Example 4 was repeated with 65/35 DP Red Kap Industrial work shirts that were dry cleaned 10 times at 30° C for 30 minutes per cycle. The formulations contained 251 milliliters perchloroethylene, 0.5% isopropylamine salt of dodecylbenzenesulfonate (Atlas G-711) and a total of 2.75 milliliters water. Results are set forth in Table V.

The invention being thus described, it will be obvious that the same may be varied in many ways. Such variations are not to be regarded as a departure from the spirit and scope of the invention, and all such modifications are intended to be included within the scope of the following claims.

TABLE I

| EXAMPLE I | pH | DRY CLEANING SYSTEM | % STAIN REMOVAL BLOOD | COFFEE | BLUE-BERRY | LIP STICK | BALL-POINT INK | USED MOTOR OIL | MUS-TARD | AVERAGE 7 STAINS |
|---|---|---|---|---|---|---|---|---|---|---|
| Comparative Run A | 6.7 | 1.9% $H_2O$ alone | 1 | 28 | 42 | 67 | 58 | 65 | 62 | 46.1 |
| B | 6.9 | 0.14% $H_2O_2$ | 4 | 35 | 54 | 65 | 60 | 67 | 61 | 49.4 |
| C | 8.6 | 1.9% $H_2O$ + 0.12% STPP | −5 | 48 | 40 | 43 | 49 | 67 | 50 | 41.7 |
| Inventive Run 1 | 5.2 | 0.14% $H_2O_2$ + 0.12% STPP + 0.064% SA/BA 2/1 | 23 | 82 | 90 | 73 | 58 | 80 | 69 | 67.9 |
| 2 | 5.7 | 0.14% $H_2O_2$ + 0.12% STPP + 0.11% BA | −.8 | 49 | 65 | 57 | 60 | 83 | 44 | 51 |
| 3 | 5.8 | 0.14% $H_2O_2$ + 0.12% STPP + 0.048% SA | −3.0 | 55 | 70 | 67 | 61 | 80 | 43 | 53.3 |
| 4 | 4.5 | 0.14% $H_2O_2$ + 0.12% STPP + 0.063% SA/PA | 18 | 78 | 90 | 73 | 69 | 84 | 76 | 69.7 |
| 5 | 6.8 | 0.14% $H_2O_2$ + 0.34% STPP + 0.12% TACA | 21 | 72 | 78 | 64 | 57 | 77 | 64 | 61.9 |
| Run 6 | 4.7 | 0.14% $H_2O_2$ + 0.12% STPP + 0.048% IPA | −1.0 | 50 | 64 | 52 | 70 | 73 | 61 | 52.7 |
| 7 | 5.2 | 0.08% $H_2O_2$ + 0.02% STPP + 0.053% TAED | −0.5 | 32 | 75 | 77 | 56 | 75 | 68 | 54.6 |
| 8 | 3.9 | 0.14% $H_2O_2$ + 0.02% STPP + 0.023% HCOOH | 13 | 27 | 52 | 73 | 66 | 78 | 52 | 51.6 |
| 9 | 5.1 | 0.064% Peracetic Acid + 0.12% STPP | 57 | 80 | 73 | 60 | 62 | 77 | 73 | 68.9 |
| 10 | 5.2 | 0.002% STPP + 0.1% m-chloroperbenzoic acid | 10 | 37 | 33 | 77 | 46 | 79 | 50 | 47.4 |

TABLE II

| EXAMPLE | 2 pH | DRY CLEANING SYSTEM | % STAIN REMOVAL BLOOD | COFFEE | BLUE-BERRY | LIP-STICK | BALL-POINT INK | USED MOTOR OIL | MUS-TARD | AVERAGE 7 STAINS |
|---|---|---|---|---|---|---|---|---|---|---|
| Inventive Run 11 | 2.3 | 0.82% $H_2O_2$ + 0.023% TSPP + 0.069% PA | 15 | 55 | 84 | 78 | 79 | 81 | 76 | 66.9 |
| 12 | 3.1 | 0.14% $H_2O_2$ + 0.02% STPP + 0.069% PA | 11 | 52 | 78 | 75 | 78 | 81 | 62 | 62.4 |
| 13 | 5.2 | 0.14% $H_2O_2$ + 0.07% STPP + 0.069% PA | 15 | 59 | 71 | 68 | 68 | 79 | 77 | 62.4 |
| 14 | 3.3 | 0.14% $H_2O_2$ + 0.024% NaOH + 0.069% PA | 4 | 36 | 64 | 76 | 79 | 76 | 60 | 56 |
| 15 | 5.2 | 0.14% $H_2O_2$ + 0.04% STPP + 0.03% NaOH + 0.069% PA | .3 | 39 | 64 | 58 | 57 | 74 | 62 | 50.6 |
| 16 | 3.5 | 0.078% $NaBO_3 . 4H_2O$ | | | | | | | | |

TABLE II-continued

| EXAMPLE | 2 pH | DRY CLEANING SYSTEM | % STAIN REMOVAL BLOOD | COFFEE | BLUE-BERRY | LIP-STICK | BALL-POINT INK | USED MOTOR OIL | MUS-TARD | AVERAGE 7 STAINS |
|---|---|---|---|---|---|---|---|---|---|---|
| | | + 0.02% STPP + 0.069% PA | 3 | 26 | 56 | 79 | 73 | 79 | 68 | 54.9 |

TABLE III

| EXAMPLE 2 | SYSTEM | pH | TYPE FABRIC | TENSILE STRENGTH POUNDS/INCH² (AVERAGE 5 STRIPS) | % Standard DEVIATION | ELONGATION | % Standard DEVIATION |
|---|---|---|---|---|---|---|---|
| Control | $H_2O$ alone | 6.7 | 65/35 PE/C | 48.9 | 1.32 | .85 | .04 |
| Inventive Run 17 | 0.14% $H_2O_2$ + 0.02% STPP + 0.065% PA/SA | 3.4 | " | 49.3 | 0.66 | .85 | 0.01 |
| Comparative Run D | 0.14% $H_2O_2$ | 6.9 | " | 48.3 | 3.2 | .85 | .06 |
| Control | $H_2O$ alone | 6.7 | 100% Cotton | 88.3 | 9.0 | .62 | .01 |
| Inventive Run 18 | 0.14% $H_2O_2$ + 0.02% STPP + 0.065% PA/SA | 3.4 | " | 88.2 | 6.9 | .35 | .02 |
| Comparative Run E | 0.14% $H_2O_2$ | 6.9 | " | 76.2 | 3.1 | .58 | .02 |

TABLE IV

| EXAMPLE 4 | WT. % OF 11.8% $H_2O_2$ | WT. % STPP | WT. % SA/PA | TOTAL COLOR DIFFERENCE BLUE | PINK | GREEN |
|---|---|---|---|---|---|---|
| Control | 0 | 0 | 0 | 12.4 | 3.7 | 3.0 |
| Comparative Run G | 0.14% | 0 | 0 | 12.0 | 4.0 | 2.0 |
| Inventive Run 20 | 0.14% | 0.02% | 0.065% | 24.9 | 2.6 | 2.9 |

TABLE V

| Example 5 | Milliliters of 11.8% $H_2O_2$ | Milliliters Of Base STPP | NaOH | Grams of PA | Total Color Difference Light Blue | Yellow | Tan | Green | Navy Blue |
|---|---|---|---|---|---|---|---|---|---|
| Control | 0 | 0 | 0 | 0 | 2.2 | 1.8 | 4.2 | 1.7 | 0.9 |
| Inventive Run 21 | 0.35 | 0.77 | 1.80 | 0.18 | 3.5 | 3.0 | 6.4 | 4.3 | 2.3 |

What is claimed is:

1. An improved dry cleaning emulsion formulation consisting essentially of:
   a. about 0.1 to about 30% by weight water;
   b. about 0.1 to about 5.0% by weight of a surfactant which is capable of emulsifying water in a dry cleaning solvent or a dry cleaning solvent in water and which does not react with a peracid;
   c. a sufficient amount of an emulsion soluble peracid to provide about 0.001 to 0.15% by weight active oxygen;
   d. a sufficient amount of alkali to maintain the pH value of the emulsion from 2.0 to 9.0; and
   e. the remainder being at least 69% by weight dry cleaning solvent.

2. The formulation of claim 1 containing 1 to 3% by weight water.

3. The formulation of claim 1 containing 96.0 to 98.7% by weight dry cleaning solvent.

4. The formulation of claim 1 containing a sufficient amount of peracid to provide about 0.002 to 0.004% by weight active oxygen.

5. The formulation of claim 1 wherein the peracid is selected from the group consisting of: perbenzoic acid, monoperphthalic acid, permaleic acid, peracetic acid, performic acid, perpropionic acid, p-nitroperbenzoic acid, perazelaic acid and m-chloroperbenzoic acid.

6. The formulation of claim 1 wherein said peracid is formed by the reaction of a peroxygen compound and an activator for said peroxygen compound, said peroxygen compound and activator having a molar ratio of 1:0.5 to 2.0.

7. The formulation of claim 1 wherein said alkali is a water-soluble inorganic polyphosphate salt.

8. An improved dry cleaning emulsion formulation consisting essentially of:
   a. about 0.1 to about 30% by weight water;
   b. about 0.08 to about 12% by weight water-soluble inorganic polyphosphate salt based on the weight of water;

c. about 0.1 to about 5.0% by weight of a surfactant which is capable of emulsifying water in a dry cleaning solvent or a dry cleaning solvent in water and which does not react with a peracid;

d. a sufficient amount of an emulsion soluble peracid to provide about 0.001 to 0.15% by weight active oxygen; and e. the remainder being at least 69% by weight dry cleaning solvent; said formulation having a pH value from 2.0 to 9.0.

9. The formulation of claim 8 containing 0.4 to 1.6% by weight inorganic polyphosphate salt based on the weight of water.

10. The formulation of claim 8 containing a sufficient amount of peracid to provide about 0.002 to 0.004% by weight active oxygen.

11. The formulation of claim 8 wherein said water-soluble inorganic polyphosphate salt is selected from the group consisting of sodium tripolyphosphate, tetrasodium pyrophosphate, potassium tripolyphosphate, tetrapotassium pyrophosphate, sodium acid pyrophosphate, and glassy phosphates.

12. An improved dry cleaning emulsion formulation consisting essentially of:

a. 1 to 3% by weight water;

b. 0.4 to 1.6% by weight water-soluble inorganic polyphosphate salt based on the weight of water;

c. 0.1 to 1% by weight of a surfactant which is capable of emulsifying water in a dry cleaning solvent or a dry cleaning solvent in water and which does not react with a peracid;

d. a sufficient amount of an emulsion soluble peracid to provide 0.001 to 0.15% by weight active oxygen and e. the remainder being at least 96% by weight dry cleaning solvent; said formulation having a pH value between 5.0 and 7.0.

13. A process for cleaning textile fabric, which comprises: contacting the textile fabric with a dry cleaning emulsion formulation consisting essentially of:

a. about 0.1 to about 30% by weight water;

b. about 0.1 to about 5.0% by weight of a surfactant which is capable of emulsifying water in a dry cleaning solvent or a dry cleaning solvent in water and which does not react with a peracid;

c. a sufficient amount of an emulsion soluble peracid to provide about 0.001 to 0.15% by weight active oxygen;

d. the remainder being at least 69% by weight dry cleaning solvent; for a sufficient time to complete the desired bleaching reaction at temperatures from 20° C to 55° C; and recovering a cleaned textile fabric.

14. The process of claim 13 wherein the textile fabric is contacted with a sufficient amount of the dry cleaning bath to provide about 0.05 to about 5.0% peracid based on the weight of the fabric being treated.

15. The process of claim 13 wherein the textile fabric is contacted with a sufficient amount of the dry cleaning bath to provide 0.07 to 0.12% peracid based on the weight of the fabric being treated.

16. A process for cleaning textile fabric, which comprises: contacting the textile fabric with a dry cleaning solvent bath prepared by emulsifying at least 69% by weight of a dry cleaning solvent and about 1.0 to about 3.0% by weight water with a surfactant capable of emulsifying the water in said solvent; adjusting the pH value of the bath from 2.0 to 9.0 with a sufficient amount of an aqueous alkaline solution, admixing the resulting emulsion with a sufficient amount of an emulsion soluble peracid added as such or prepared in situ by the reaction of a peroxygen compound and an activator for said peroxygen compound to provide about 0.001 to 0.15% by weight active oxygen, said peroxygen compound being soluble in the water phase of the emulsion and said activator being soluble in the solvent phase, agitating the emulsion to supply activator to the water phase where the activator is rapidly reacted with the peroxygen to form the corresponding peracid; maintaining the textile fabric in contact with the peracid until the desired bleaching reaction is completed; and recovering a cleaned textile fabric.

17. The process of claim 16 wherein the peracid is added to the dry cleaning solvent as a preformed peracid selected from the group consisting of perbenzoic acid, monoperphthalic acid, permaleic acid, peracetic acid, performic acid, perpropionic acid, p-nitroperbenzoic acid, and m-chloroperbenzoic acid.

18. The process of claim 16 wherein the peracid is prepared by the reaction of a peroxygen compound selected from the group consisting of hydrogen peroxide, sodium perborate, sodium carbonate peroxide, sodium pyrophosphate perhydrate, zinc peroxide, magnesium peroxide, calcium peroxide, urea peroxide and potassium caroate, and an activator for said peroxygen compound wherein the molar ratio of activator to peroxygen compound is 0.5 to 2:1.

19. The process of claim 16 wherein the activator is phthalic anhydride, nonenylsuccinic anhydride, 4-chlorophthalic anhydride, trisacetyl cyanurate, phthalic/benzoic anhydride, or polyazelaic polyanhydride.

* * * * *

UNITED STATES PATENT OFFICE

CERTIFICATE OF CORRECTION

PATENT NO. : 4,013,575

DATED : March 22, 1977

INVENTOR(S) : Harry M. Castrantas and John T. Gresham

It is certified that error appears in the above-identified patent and that said Letters Patent are hereby corrected as shown below:

Column 2, line 32, "3,635,67." should read --3,635,667--; column 2, line 41, "through" should read --though--. Column 5, line 24, "25% the" should read --25% of the--. Column 6, line 16, "web" should read --wet--. Column 7, Table II, under "Dry Cleaning System", Run 11, "0.82%" should read --0.082%--; column 7, Table II, under "Dry Cleaning System", Run 11, "TSPP" should read --STPP--. Columns 9 and 10, Table III, rest of the table was omitted.

TABLE III CONTINUED

| EXAMPLE 3 | SYSTEM | pH | TYPE FABRIC | TENSILE STRENGTH POUNDS/INCH$^2$ (AVERAGE 5 STRIPS) | % Standard DEVIATION | ELONGATION | % Standard DEVIATION |
|---|---|---|---|---|---|---|---|
| Control | $H_2O$ alone | 6.7 | 100% ALMI$_{TM}$ Cotton | 76.1 | 3.7 | .31 | .01 |
| Inventive Run 19 | 0.14% $H_2O_2$ + 0.02% STPP + 0.065% PA/SA | 3.4 | " | 80.7 | 3.6 | .25 | .01 |
| Comparative Run F | 0.14% $H_2O_2$ | 6.9 | " | 70.7 | 7.1 | .30 | .02 |

Signed and Sealed this

Sixteenth Day of May 1978

[SEAL]

Attest:

RUTH C. MASON
Attesting Officer

LUTRELLE F. PARKER
Acting Commissioner of Patents and Trademarks